US005090171A

United States Patent [19]

Kano et al.

[11] Patent Number: 5,090,171

[45] Date of Patent: Feb. 25, 1992

[54] MOVABLE PARTITIONING PANEL

[75] Inventors: Minoru Kano; Kiyoshi Negami; Mikio Nakatani, all of Komatsu, Japan

[73] Assignee: Komatsu Wall Industry Co., Ltd., Komatsu, Japan

[21] Appl. No.: 545,826

[22] Filed: Jun. 29, 1990

[30] Foreign Application Priority Data

| | | | |
|---|---|---|---|
| Aug. 1, 1989 | [JP] | Japan | 1-99904 |
| Aug. 7, 1989 | [JP] | Japan | 1-92720[U] |
| Aug. 10, 1989 | [JP] | Japan | 1-207182 |
| Feb. 15, 1990 | [JP] | Japan | 2-14005[U] |

[51] Int. Cl.[5] ..... E04B 2/82

[52] U.S. Cl. ..... 52/243.1; 49/409; 160/199; 52/710

[58] Field of Search ..... 52/243.1, 710; 160/118, 160/196.1, 199; 49/409, 410, 411, 208, 260, 127

[56] References Cited

U.S. PATENT DOCUMENTS

| | | | |
|---|---|---|---|
| 1,411,561 | 4/1922 | Beeman | 49/260 |
| 3,287,759 | 11/1966 | Foltz | 40/409 |
| 3,494,407 | 2/1970 | Hollands et al. | 160/199 |
| 3,708,916 | 1/1973 | Karp et al. | 49/409 |
| 3,843,995 | 10/1974 | Merrill | 49/409 |
| 4,555,828 | 12/1985 | Matimura | 49/409 |
| 4,569,164 | 2/1986 | Dickson | 52/64 |

FOREIGN PATENT DOCUMENTS

| | | | |
|---|---|---|---|
| 225904 | 7/1962 | Austria | 49/409 |
| 52-55251 | 12/1977 | Japan . | |
| 54-128144 | 10/1979 | Japan . | |

*Primary Examiner*—James L. Ridgill, Jr.
*Attorney, Agent, or Firm*—Oblon, Spivak, McClelland, Maier & Neustadt

[57] ABSTRACT

The present invention relates to a movable partitioning panel which can be moved along a hanger rail disposed in a ceiling to thereby form a suitable partitioning wall within a room. Runner devices arranged within the hanger rail are rotatable irrespective of the attitude of a panel body and can be smoothly moved with the hanger rail. In addition, the panel body can be simply moved at a branch path, a bend in the path and the like through upper and lower guide rollers and a controller device for the runner devices. Furthermore, the panel body in its horizontal attitude can be closely positioned with respect to a fixed wall.

10 Claims, 8 Drawing Sheets

MOVABLE PARTITIONING PANEL

BACKGROUND OF THE INVENTION

1. Field of the Invention

The present invention relates to a movable partitioning panel which can be moved along a hanger rail laid on the ceiling to thereby divide a large room into suitable areas.

2. Discussion of Background

Department stores, hotels and the like have a large hall having a large floor area capable of being used for large-scaled exhibitions or parties. When a small party or a conference room needs to be set up, the aforementioned large hall is divided into suitable size by using a movable partitioning panel. The movable partitioning panel is composed of a hanger rail having a C-shape section laid on the ceiling and a movable panel body suspended from the hanger rail. A pair of runner devices of a carriage type are provided within the hanger rail, the runner devices being connected to the panel through hanging bolts.

On the other hand, the hanger rail is formed with a number of branch paths because an arrangement of the panel body is variously changed. The partitioning panel itself is required to be smoothly moved in any of the branch paths. For example, a devised runner device is disclosed in Japanese Patent Application Laid-Open Publication No. 54-128144, and an improved panel body is disclosed in Japanese Utility Model Publication No. 52-55251.

Recently, the movable partitioning panel has been required to have a performance similar to that of a fixed wall in terms of sound shielding and aesthetics. Therefore, the partitioning panel unavoidably becomes large and heavy, which specifically poses the following problems.

(1) A heavy load is applied to the runner devices disposed within the hanger rail, and a large frictional resistance occurs between the runner devices and a sliding seat of the hanger rail so as to impair a smooth movement of the partitioning panel. Particularly when the runner devices arrive at a bend or a branch point of the hanger rail, travelling resistance in the runner devices increases to impede the panel moving work.

(2) As shown in the aforementioned Japanese Utility Model Publication, a controller is provided on the panel body to move the panel at the branch point of the hanger rail or the like, and said runner devices and the panel body are movably connected through the hanging bolts. However, the controller cannot be moved smoothly due to the frictional resistance with respect to the panel body. On the contrary, smooth movement of the partitioning panel is impaired.

(3) Furthermore, the panel body has to be disposed in an accurately vertical attitude with respect to the floor surface when the partitioning wall is formed. However, a large panel body sometimes tends to be inclined.

(4) Due to the larger and heavier panel body and the like, execution and maintenance become difficult. Thus, it becomes difficult to repair a mounting portion between the runner devices and the controller.

SUMMARY OF THE INVENTION

The present invention has been achieved in view of problems noted above. It is a principal object of the present invention to provide a movable partitioning panel which can be smoothly moved along any place such as a branch path, a bend in a path and the like of a hanger rail.

More specifically, the object of the present invention is (a) to reduce the frictional resistance in the runner devices as low as possible so that the panel may be smoothly moved within the hanger rail even in the branch path, the bend in a path and the like, (b) to allow the controller movable with a small frictional resistance with respect to the panel body, and accurately dispose the panel body in a vertical attitude, and (c) to allow the runner devices, the controller and the panel body to be easily detachable, and render the execution and the maintenance such as repair possible to be accomplished simply.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Preferred embodiments of the present invention will be described hereinafter with reference to the drawings.

Figure 1:
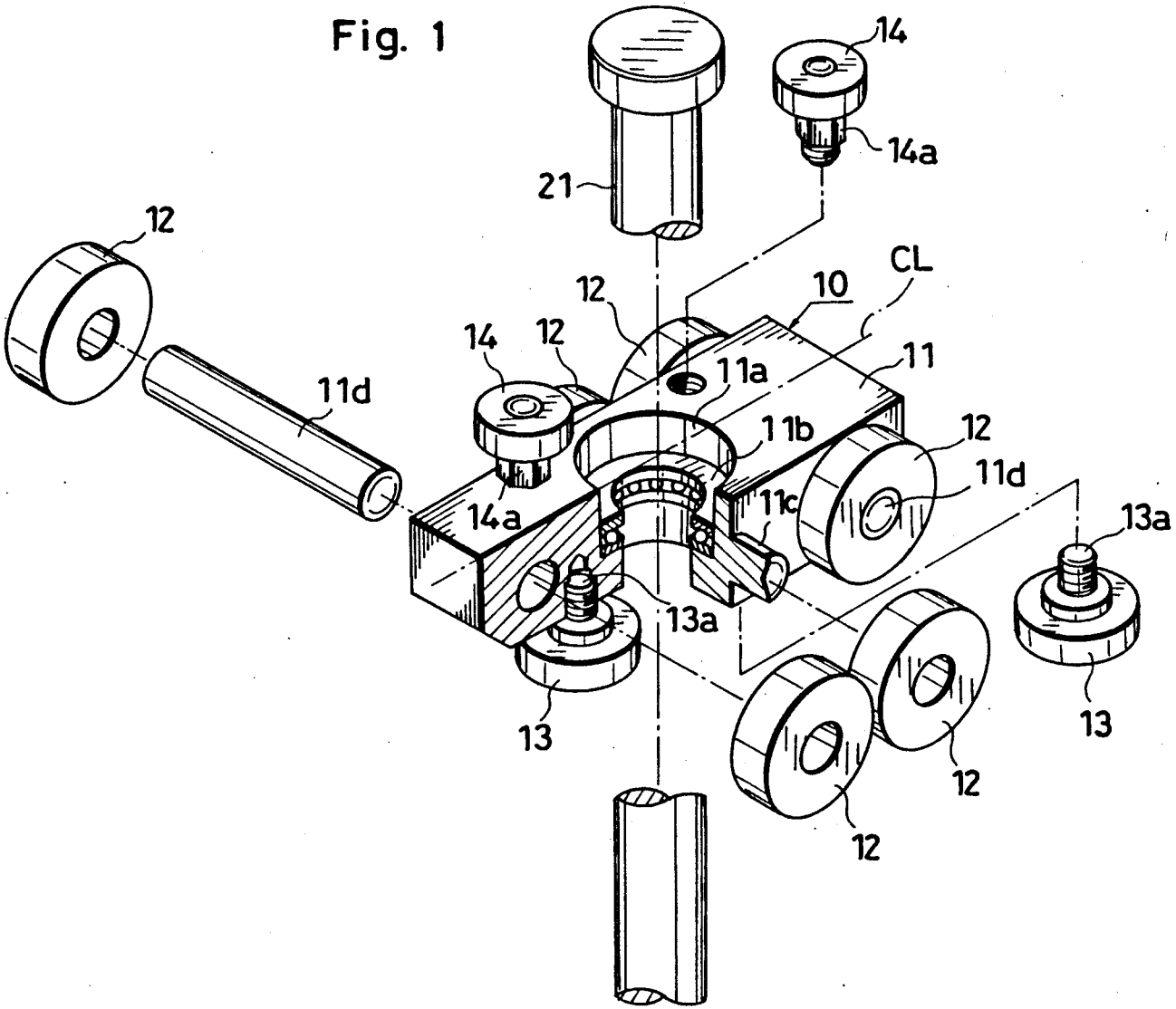
FIG. 1 is an explanatory view of an assembly showing an embodiemnt of a runner device.

FIG. 1 shows a runner device which is disposed within a hanger rail and travels within the hanger rail. The main constituent members of the runner device (hereinafter merely referred to as a runner) 10 comprise a runner body 11, travel rollers 12, 12 . . . , lower guide rollers 13, 13 and upper guide rollers 14, 14.

The runner body 11 is formed into a laterally extending approximately rectangular parallelopiped and formed in its central portion with a through hole 11*a* with a shoulder which vertically extends. A thrust bearing 11*b* is mounted on the shoulder of the through hole 11*a*. The runner body 11 rotable suspends a hanging bolt 21 for the panel body through the thrust bearing 11*b*. Accordingly, the hanging bolt 21 of the runner body 11 can be smoothly rotated due to a rolling friction of the bearing 11*b*.

Three pairs or six wheels in all of the travel rollers 12, 12 are rotatably mounted on shafts 11*c*, 11*d* and 11*d* on the left and right sides of the runner body. The six wheels can be simultaneously placed in contact with the road on the same plane.

The lower guide rollers 13, 13 are rotatably mounted in front of and behind the lower surface of the runner body 11. The lower guide rollers 13, 13 are mounted on opposite sides between which is sandwiched the hanging bolt 21 on a center line CL in a lateral direction of the runner body 11 through mounting bolts 13*a* and 13*a* threadedly mounted on the lower surface of the runner body 11.

Figure 2:
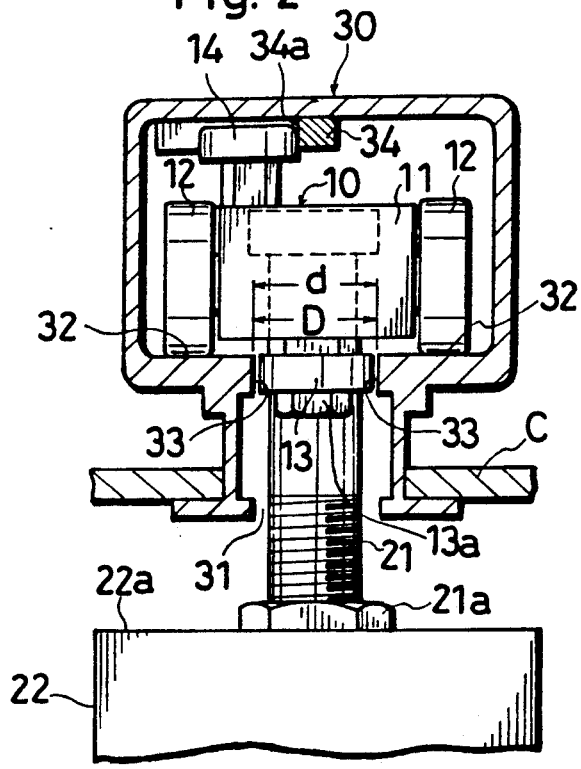
FIG. 2 is an explanatory view of arrangement in section of the runner device shown in FIG. 1.

The upper guide rollers 14 and 14 are rotatably mounted through mounting bolts 14*a*, 14*a* in front of and behind the upper surface of the runner body 11. However, the upper guide rollers 14 and 14 are not disposed on the center line CL of the runner body but are disposed so as to be one-sided toward one side. A hanger rail 30 on which the runner 10 travels is laid with an opening 31 directed downward, said opening 31 being formed of a lengthy shape material having a generally C-shape in section as shown in FIG. 2 and contineous in a longitudinal direction of the rail. The hanger rail 30 is interiorly formed with left and right travel surfaces 32, 32 on which the left and right travel rollers 12, 12 . . . of the runner 10 roll. The hanger rail 30 is formed internally with travel guide surfaces 33, 33 so that the lower guide rollers 13, 13 roll along the travel guide surfaces 33, 33. A distance d between the travel guide surfaces 33, 33 is set slightly larger than a diameter D of the lower guide roller 13 to thereby define an unnecessary movement of the runner in the lateral direction.

Figure 3:
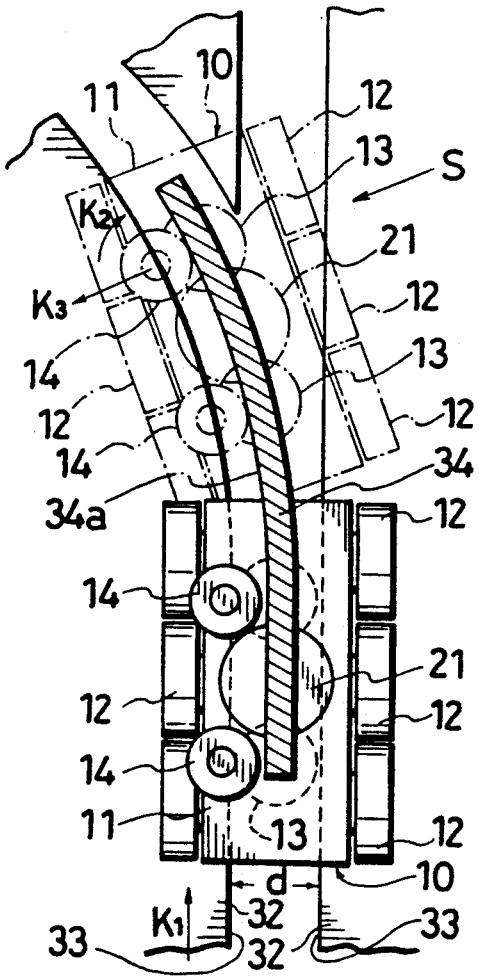
FIG. 3 is an explanatory view of operation of the runner device shown in FIG. 1.
Figure 4:
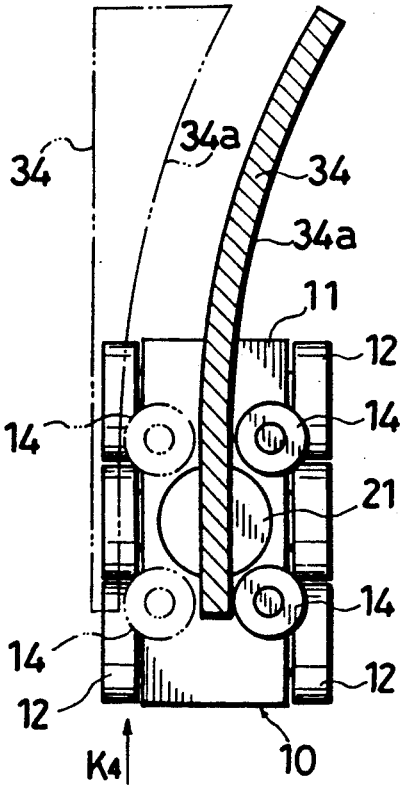
FIG. 4 is a plan view showing another example of the runner device.

In the hanger rail 30, a branch point S is provided at a predetermined location as shown in FIG. 3, and a guide rail 34 in contact with the upper guide rollers 14, 14 is installed upwardly in the vicinity of the branch point S (See FIGS. 2, 3 and 4). The guide rail 34 has a guide surface 34*a* which is gently curved along the branched hanger rail 30, the guide surface 34 deteriming the travel way of the runner 10. That is, the upper guide rollers 14 and 14 of the runner 10 roll along the guide surface 34*a* of the guide rail 34 whereby the whole runner 10 may change its way along the guide rail 34.

It is noted that a set of movable partitioning panels are composed of a panel body 22, two hanging bolts 21, 21 projected from the upper end surface 22*a* of the panel body and runners 10, 10 for supporting the hanging bolts 21, 21, respectively.

In moving a moving direction of the movable partitioning panel from the direction of $K_1$ of FIG. 3 to the left hanger rail, an operator pushes the partitioning panel 22 whereby the front runner 10 moves close to the branch point from the direction as indicated at $K_1$. Since the distance d between the travel guide surfaces 33 and 33 of the hanger rail 30 gradually increases at the branch portion, the moving course of the runner 10 cannot be determined by the lower guide rollers 13, 13. Therefore, the guide rail 34 defines the upper guide rollers 14, 14 to guide the whole runner 10. That is, when the upper guide roller 14 comes into contact with the guide surface 34*a* of the guide rail 34, the upper guide roller 14 rotates in a direction as indicated at $K_2$ and at the same time moves along the guide surface 34*a* so that the front end of the runner 10 can be changed in direction to the left (indicated at the phantom outline in FIG. 3).

At that time, the runner 10 produces a rotational torque due to the centripetal force about the hanging bolt 21 to facilitate a change in way of the runner 10. In this manner, when the way of the runner 10 is changed, the runner 10 rotates relative to the panel body 22. However, since the panel body 22 is supported on the runner 10 through the thrust bearing 11*b*, the relative rotation therebetween can be smooth rotation due to the rolling friction.

When the runner 10 passes through the branch point S, the lower guide rollers 13, 13 can again travel while being guided by the guide surfaces 33, 33.

In changing the way of each runner 10, the travel rollers 12, 12 . . . on one side obliquely cross the opening between the travel guides 33 and 33 (as indicated at the phantom outline of FIG. 3). However, at least two travel rollers 12 among the three travel rollers 12, 12 . . . on one side can be always placed in contact with the travel surface 32, and therefore the attitude of the runner 10 can be maintained horizontal even at that time. The runner 10 can smoothly pass the branch point S. However, in the case where the distance d between the travel guides 33, 33 is sufficiently small, the travel rollers 12, 12 . . . in the form of two pairs and four wheels instead of three pairs and six wheels can be practically used without any convenience.

When it is desired that the path runner 10 is changed toward the right relative to the direction indicated at $K_4$ as shown in FIG. 4, a guide rail 34 curved to right and the upper guide rollers 14 and 14 mounted to the right of the upper surface of the runner 10 may be combined. Since the guide rail 34 is sufficient to impart to the upper guide rollers 14, 14 a centripetal force to the right at a right angle to the moving direction, the upper guide rollers 14 and 14 are mounted on the left side of the upper surface of the runner 10 (indicated by the dash-dotted contour lines) and further combined with the guide rail 34 disposed to the left to obtain an equal operation.

Figure 5:
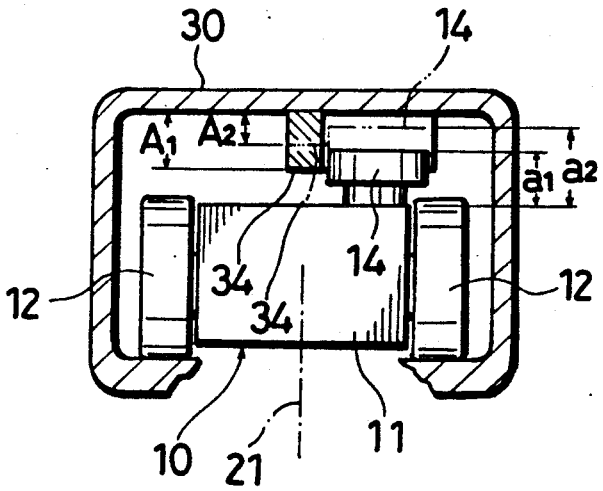
FIG. 5 is an explantory view of an arrangement in section of the runner device shown in FIG. 4.

By selecting height dimensions $A_1$ and $A_2$ of the guide rail 34 and mounting heights $a_1$ and $a_2$ of the upper guide rollers 14 and 14 as shown in FIG. 5, the presence or absence of engagement therebetween, that is, the presence or absence of the change in the path of the runner 10 can be selected. For example, since two upper guide rollers 14 and 14 having the mounting heights $a_1$ and $2_2$ engage the guide rail 34 having the height dimension $A_1$, the path of the two runners 10 and 10 having these upper guide rollers 14 and 14 can be changed. However, the upper guide roller 14 having the mounting height $a_1$ does not engage the guide rail 34 having the height dimension $A_2$ but the upper guide roller 14 having the mounting height $a_2$ alone engaged therewith. Accordingly, on the runner 10 having the upper guide roller 14 is to change its path.

Figure 6:
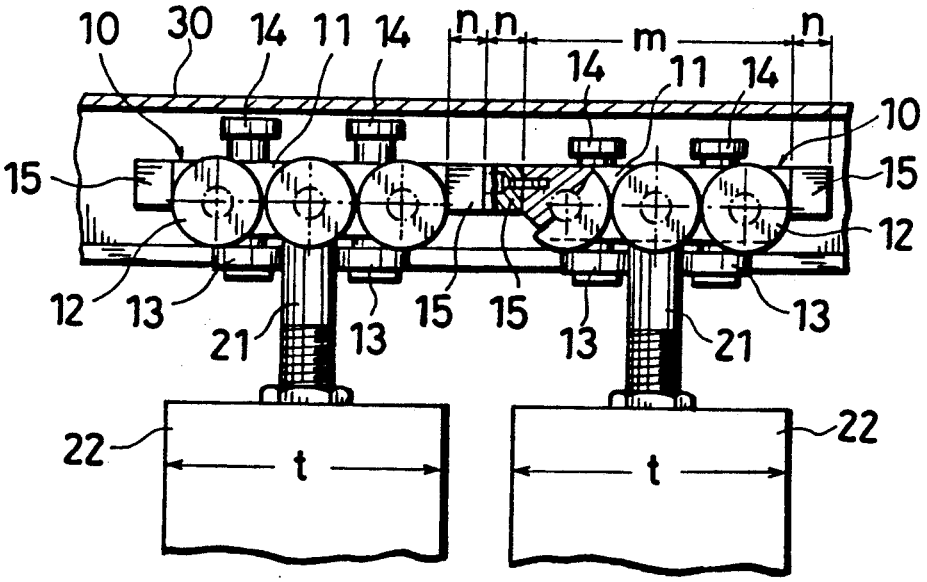
FIG. 6 is a side sectional view showing a further example of the runner device.

Spacers 15 and 15 as shown in FIG. 6 can be mounted on both front and rear ends of the runner 10. An effective thickness n of the spacers 15 and 15 is set so that when the thickness dimension t of the panel body 22 exceeds a length m in a lateral direction of the runner 10, the relationship of $m+2n>t$ is established. Thereby, two panel bodies 22 and 22 are not in contact, and therefore, it is possible to effectively prevent the panel bodies 22 from being broken.

As described above, the upper guide rollers are mounted in front of and behind of the upper surface of the runner, and the thrust bearing is disposed between the runner and the hanging bolt whereby when the runner changes its path, the effective rotational torque for changing the direction of the runner is produced and the frictional resistance between the guide rail and the upper guide rollers and between the runner and the hanging bolt can be changed from sliding friction to rolling friction. Therefore, there may be provided excellent effects in that the travel resistance of the whole runner can be suppressed to be small and even the path of a heavy movable partitioning can be easily changed.

Figure 7:
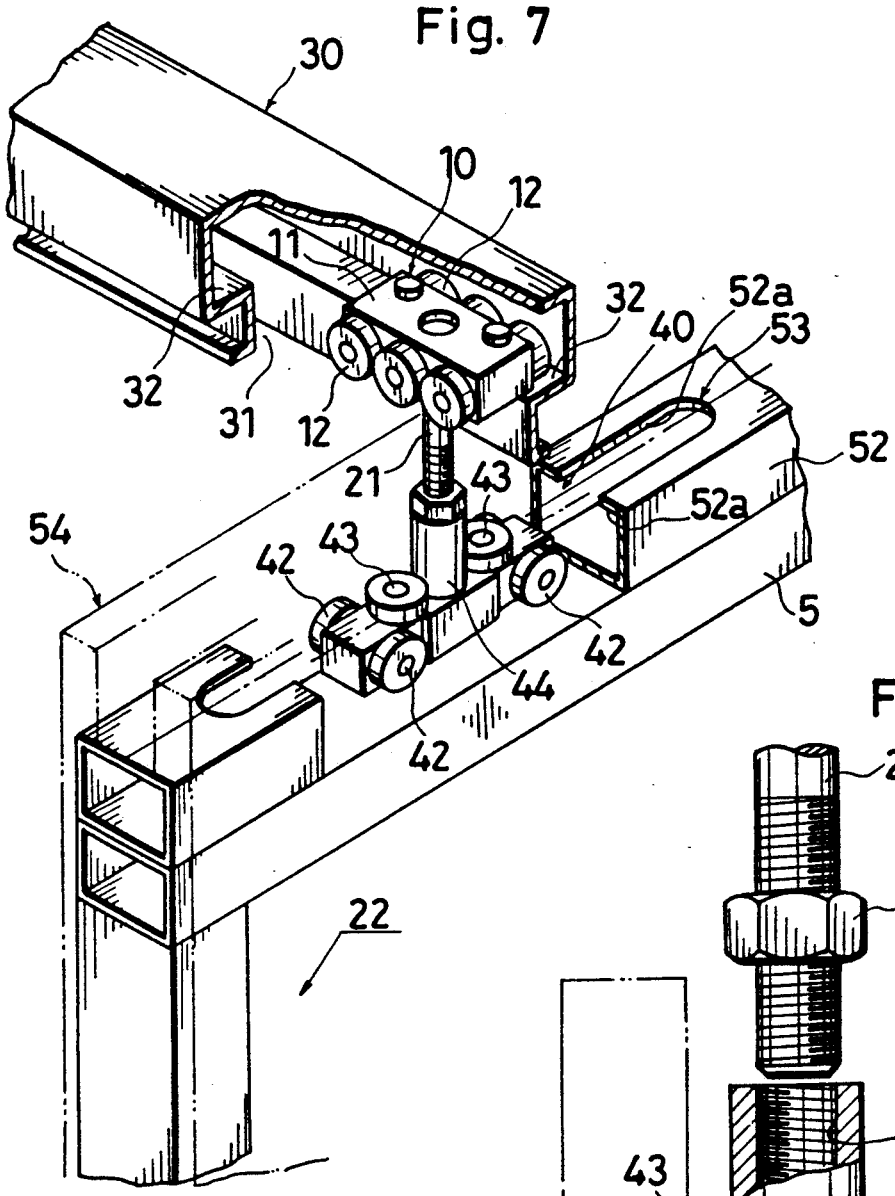
FIG. 7 is a perspective view showing an example of a controller device.
Figure 8:
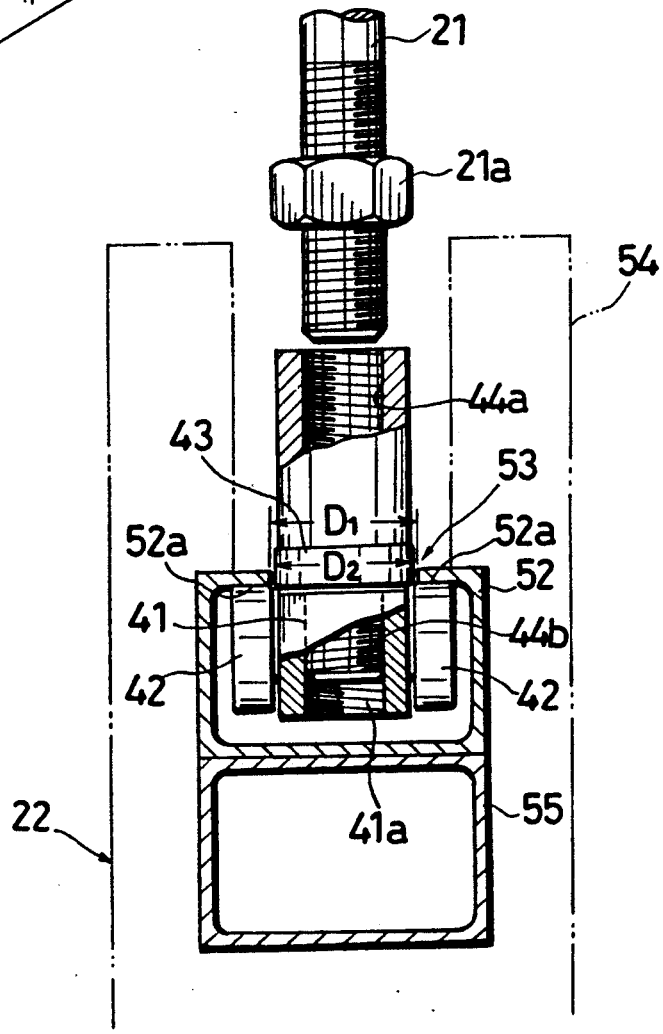
FIG. 8 is an explantory view of an arrangement in section of the controller device shown in FIG. 7.

FIGS. 7 and 8 shows a controller device 40 provided on the panel body 22. The controller device 40 comprises a socket 44, a body block 41, hanging rollers 42 . . . and guide rollers 43, 43.

The socket 44 is formed from a cylindrical member having a male thread 44*b* on the bottom thereof and having a male thread 44*a* in an upper inner peripheral surface thereof.

The block 41 is formed in a central portion thereof with a vertically through extending threaded hole 41*a*, in which is inserted the male thread portion 44*b* of the socket 44. The socket 44 is provided with a laterally extending-through fixed shaft, on opposite ends of which are mounted two pairs and four wheels of hanging rollers 42 . . . The hanging rollers 42 are mounted so that a part of the outer peripheral surface thereof is projected from the upper surface of the body block 41.

On the upper surface of the body block 41 are mounted guide rollers 43 and 43 before and behind thereof. The guide rollers 43 and 43 are mounted on the body block 41 so as to sandwich the socket 44 therebetween. The guide rollers 43 and 43 are located on the center line in the lateral direction of the body block 41.

The hanging bolt 21 threadedly mounted on the socket 44 is rotatably suspended from the runner 10 through the thrust bearing as shown in FIG. 1.

The controller device 40 is movably suspended with respect to the panel body 22. That is, in the panel body 22, four ends of a plate-like core are surrounded by square frames 55, 55 . . . To the upper surface of the upper frame 55 is secured a guide member 52 having the same shape as that of the frame 55, and surface materials 54 are attached to both surfaces of the core material.

The guide member 52 is formed, in the vicinity of one end of the upper surface thereof, with a slot 53 about the center line in a longitudinal direction of the guide member 52 whereby guide seats 52*a*, 52*a* are formed on opposite sides of the slot 53. A width $D_1$ of the slot 53 is set slightly larger than a diameter $D_2$ of the guide roller 43 whereby the guide seats 52*a* and 52*a* can suppress lateral vibration of the guide rollers 43 and 43. However, the guide rollers 43 and 43 are predetermined with respect to height position so that the guide rollers may roll within the slot 53 along the slot 53.

Figure 9:
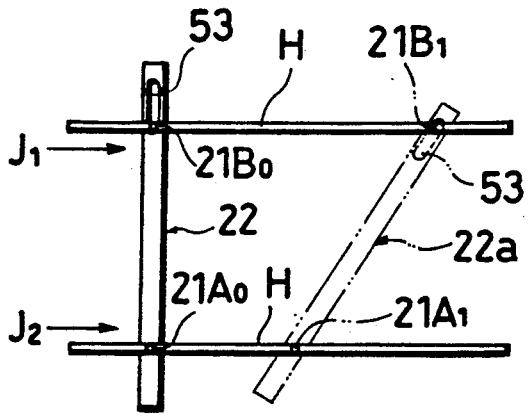
FIGS. 9 and 10 are respectively explanatory views of the controller device shown in FIG. 7.

The guide seats 52*a*, 52*a* are supported from the bottom by the hanging rollers 42 . . . , and the weight of the panel body 22 can be dispersed to each of the hanging rollers 42 through the guide member 52. Furthermore, since the guide rollers 43 and 43 roll along the slot 53, the controller device 40 can be moved laterally within the range of the length of the slot 53. Accordingly, the panel body 22 is operated as shown in FIG. 9.

A large movable partitioning panel is ordinarily operated by two operators. When the panel body 22 suspended from hanger rails H, H parallel to each other is pushed from directions as indicated at $J_1$ and $J_2$, the panel body 22 tends to be inclined with respect to the moving direction (as indicated by the dash-dotted contour lines in the figure) depending on the magnitude of the pressing force of the operator. At this time, the controller device 40 can freely travel and move within the guide member 52. Therefore, a hanging bolt $21B_0$ can be easily change in position to the location of bolt $21B_1$ in order to change the distance between other hanging bolts $21A_0$ and $21A_1$. Accordingly, the panel body 22 can be smoothly moved while suitably changing the attitude in accordance with the pressing of the operator.

Figure 10:
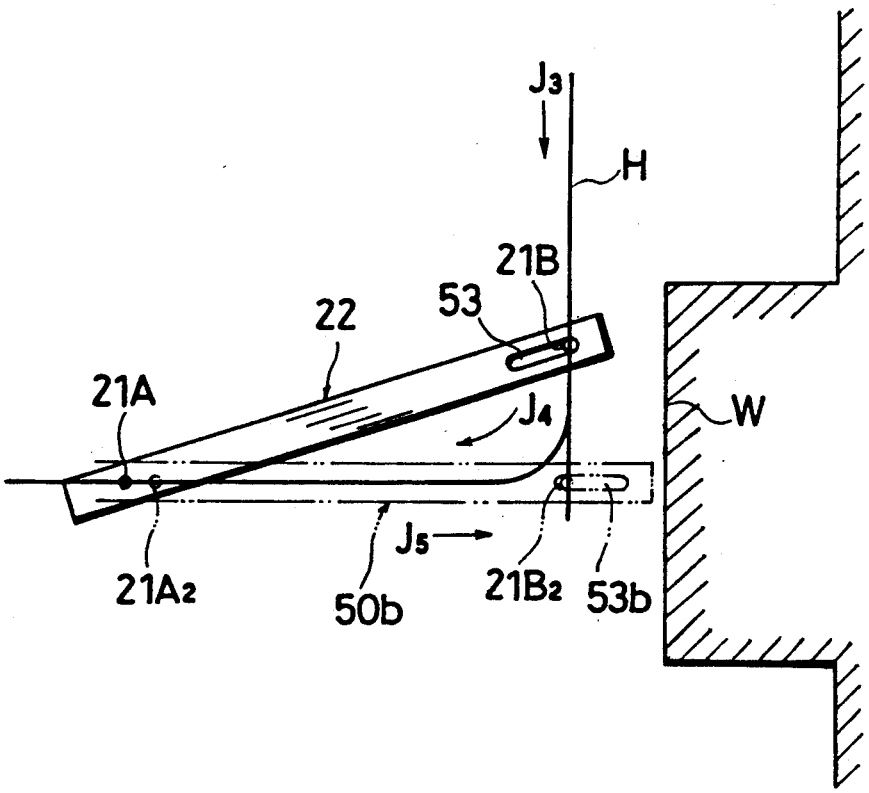

This means that it is possible to positively rotate the panel body 2 suspended from the single hanger rail H which is suitably curved. For example, in FIG. 10, the panel body 22 moved in the direction as indicated at arrow $J_3$ is moved in directions of arrows $J_4$ and $J_5$ by the hanger rail H branched into a shape Y to thereby provide an accurate one-sided motion with respect to a wall surface W (dash-dotted contour lines in the figure).

The controller device 40 is restricted in its movable range within the range of the slot 53 and can be freely adjusted and positioned as to its height by utilizing the socket 44. However, when the controller device 40 is inserted into the guide member 52', an insert opening not shown is provided which is common to the bottom of the guide member 52 and the upper surface of the frame 55.

In the above description, when the weight of the panel body 22 is great, the two pairs and four wheels of hanging rollers 42 of the controller device 40 for hanging the panel body 22 are suitably increased in number, for example, to three pairs and six wheels and four pairs and eight wheels to reduce the weight of the panel body 22 loaded on the single hanging roller 42. While the controller device is sufficient to be provided corresponding to one along among two hanging bolts 21 and 21 for hanging a single panel body 22, it is to be noted that of course, the controller device may be provided corresponding to both the hanging bolts.

As described above, the guide roller independently of the hanging roller is mounted on the upper surface of the body block to thereby render extremely small due to the rolling friction the frictional resistance produced to prevent lateral rolling of the controller device. Therefore, travelling of the controller device can be made smooth so as to improve operability of the whole movale partitioning panel. In addition, since the controller device can be connected to the hanging bolts through the socket, locating the controller device can be made easily to provide an excellent effect that the connecting operation can be extremely simplified.

Figure 11:
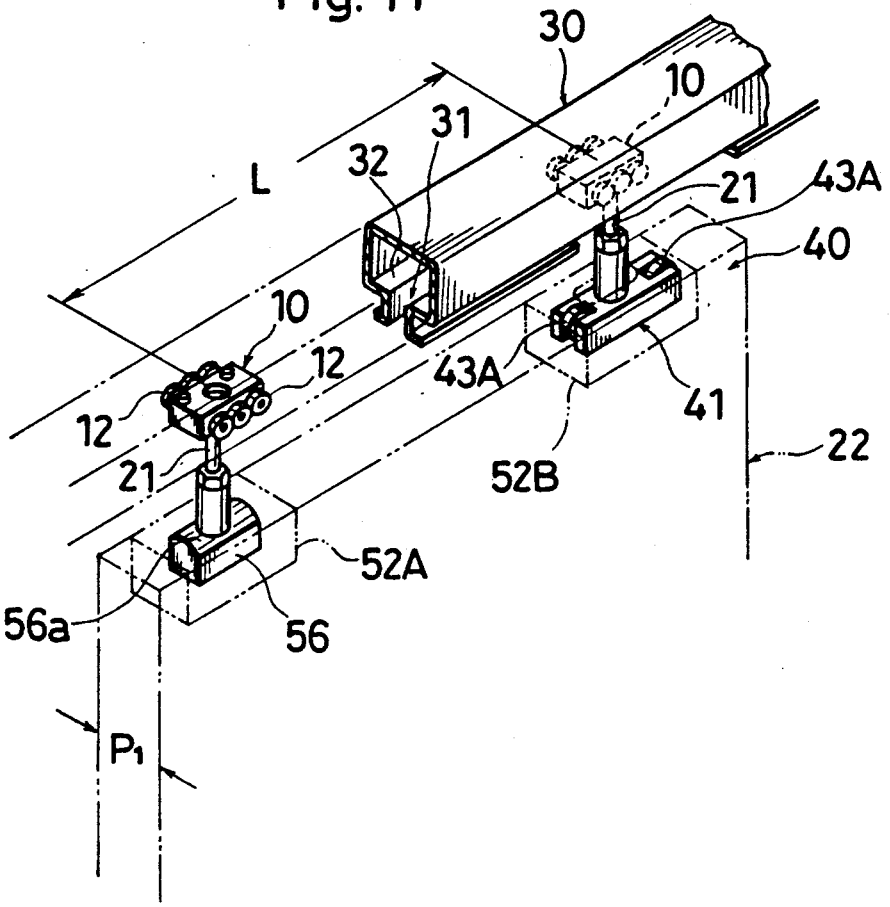
FIG. 11 is a perspective view showing another example of the controller device.

FIG. 11 shows another embodiment of the controller device 40. One of the pair of hanging bolts 21 suspended from the runner 10 is threadedly engaged with a hanger block 56. The upper surface of the hanger block 56 is of an upwardly directed convex shape, has a highest point at an approximately center position thicknesswise of the panel body 22 and is formed with curved surfaces gently inclined on opposite sides.

Figure 12:
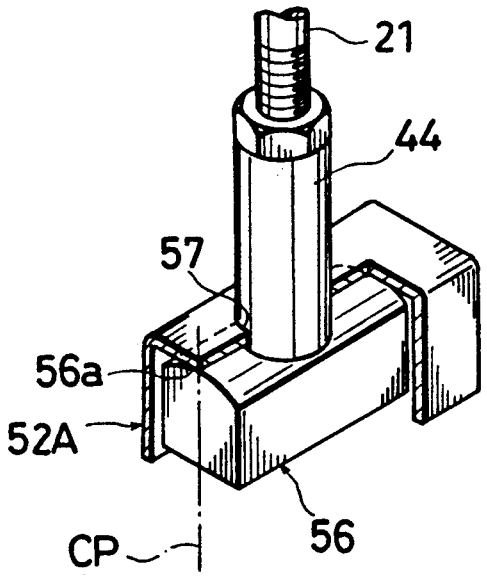
FIG. 12 is a detailed perspective view of the controller device shown in FIG. 11.
Figure 14:
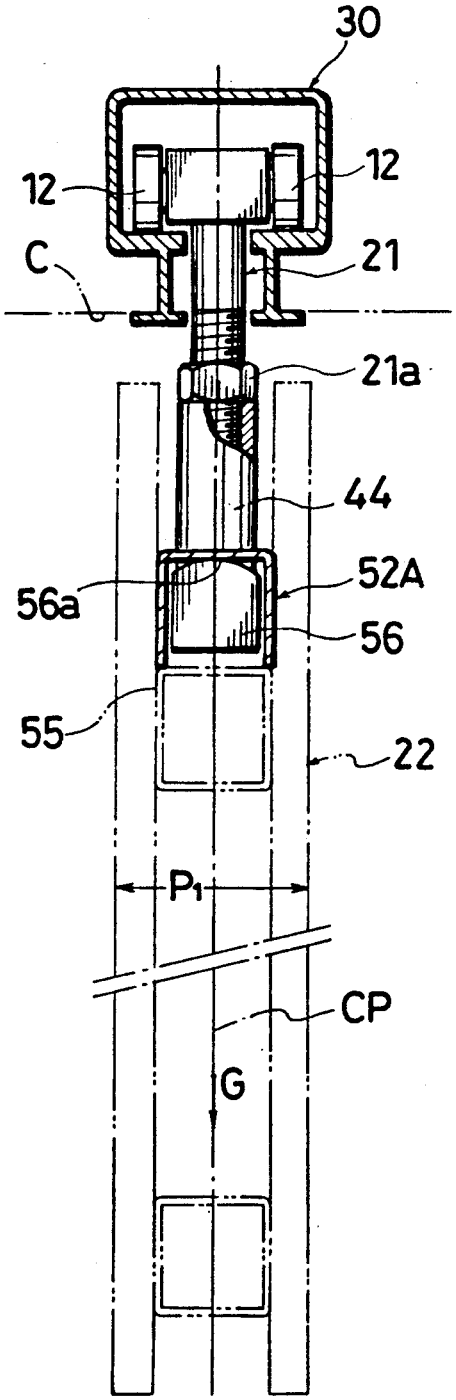
FIG. 14 is an explanatory view of operation of the controller shown in FIG. 12.

The hanger block 56 engages a hanging member 52A provided on the upper end of the panel body 22 to hang the panel body 22. The hanging member 52A is formed into a -shape in section with an opening directed downward as shown in FIG. 12 and fixed to a lateral frame upwardly of the panel body 22, and the upper surface thereof is formed with a through hole through which extends a socket portion 44 of the hanger block 56 (FIG. 14). The hanger block 56 is in linear contact with the hanging member 52A through a contact line positioned on the center line thicknesswise of the panel body.

When the panel body is moved and stopped at a predetermined position through the runner devices 10, 10 as shown in FIG. 14', the hanger block 56 can hang the panel body 22 at approximately the center of the hanging member 52A, that is, at approximately the center thicknesswise of the panel body 22. Accordingly, the panel body 22 can be swung about the straight line in which the hanger block 56 and the hanging member 52A come into linear contact, said straight line being on the center surface CP of the panel body 22. Thereby, if a center of gravity G of the panel body is on the center surface CP, the panel body 22 is always suspended correctly in a vertical direction and is not at all possibly inclined from a vertical surface.

Figure 13:
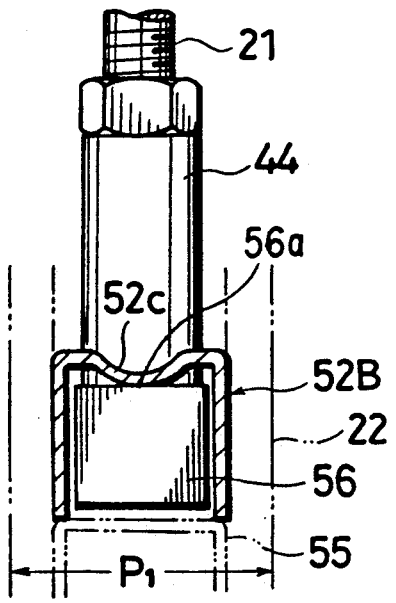
FIG. 13 is a side sectional view showing another controller device.

In FIG. 13, the upper surface of the hanger block 56 is formed into a plane and may be formed into a convex with a central portion 52C of the upper surface of the hanging member 52B in contact with the plane directed downward widthwise of the partitioning panel body. Also at that time, the hanger block 56 and the hanging member 52A are in linear contact widthwise of the panel body 22, and the contact position therebetween is set to approximately the center thicknesswise of the panel body 22. Therefore, the panel body 22 can be hung vertically similar to the previous embodiment.

Figure 15:
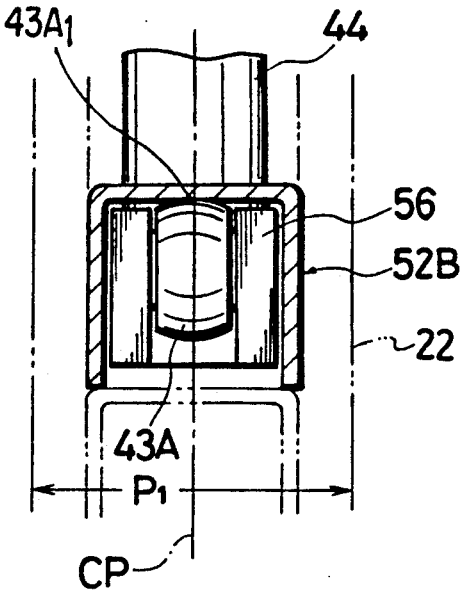
FIGS. 15 and 16 are respectively side sectional views showing an example of another controller device.
Figure 16:
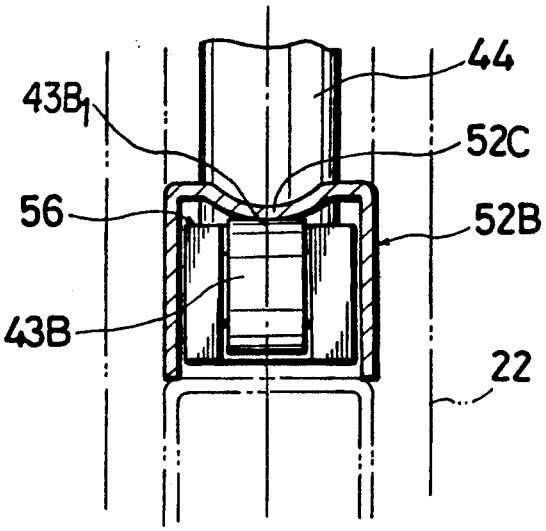

The hanger block 56 can hang the panel body 22 through roller members 43A and 43B as shown in FIGS. 15 and 16. That is, as shown in FIG. 11, the roller members 43A and 43A are arranged approximately at the center thicknesswise of the contoller device 40 and a central portion widthwise of the roller members 43A dn 43A is formed into a large diameter as shown in FIG. 15 whereby the hanger block 56 and the hanging member 52B can have point contact through the roller members 43A and 43A on the approximately center surface CP of the panel body 22. Therefore, the panel body 22 can be hung vertically. It is to be noted that as shown in FIG. 16, the roller member 43B may be merely formed into a columnar shape, and the upper surface 52c of the hanging member 52b may be formed with a convex shape while being directed downward.

When the hanger block 56 is provided with the roller member 43A or 43B, a through-hole 57 in the upper surface of the hanging member 52B is formed as a slot whereby the hanger block 56 can be moved relative to the hanging member 52B depending on of the length of the through-hole 57. Therefore, if the controller device 40 provided with the roller member 43A or 43B as described above is mounted on at least one of the front portion and rear portion of the panel body 22, the controller device 40 can vary the distance between both the hanging bolts. The hanger block 56 may have a point contact $43_A$ and $43_B$ as shown in FIGS. 15, 16 and 17 or may have a line contact 56a as shown in FIGS. 11-14.

As described above, the hanger block may hang the panel body at approximately the center thicknesswise of the panel body whereby when the panel body is at rest in a stable state, the center thicknesswise of the upper end of the panel body and the center of gravity of the panel can assume the same vertical position, and at this time, the panel body can be correctly hung vertically. Therefore, there is provided an excellent effect in that even in the case where a plurality of panel bodies are aligned, the surfaces thereof will not be irregular and the movable partitioning panels can be always formed in an orderly aligned state.

Figure 17:
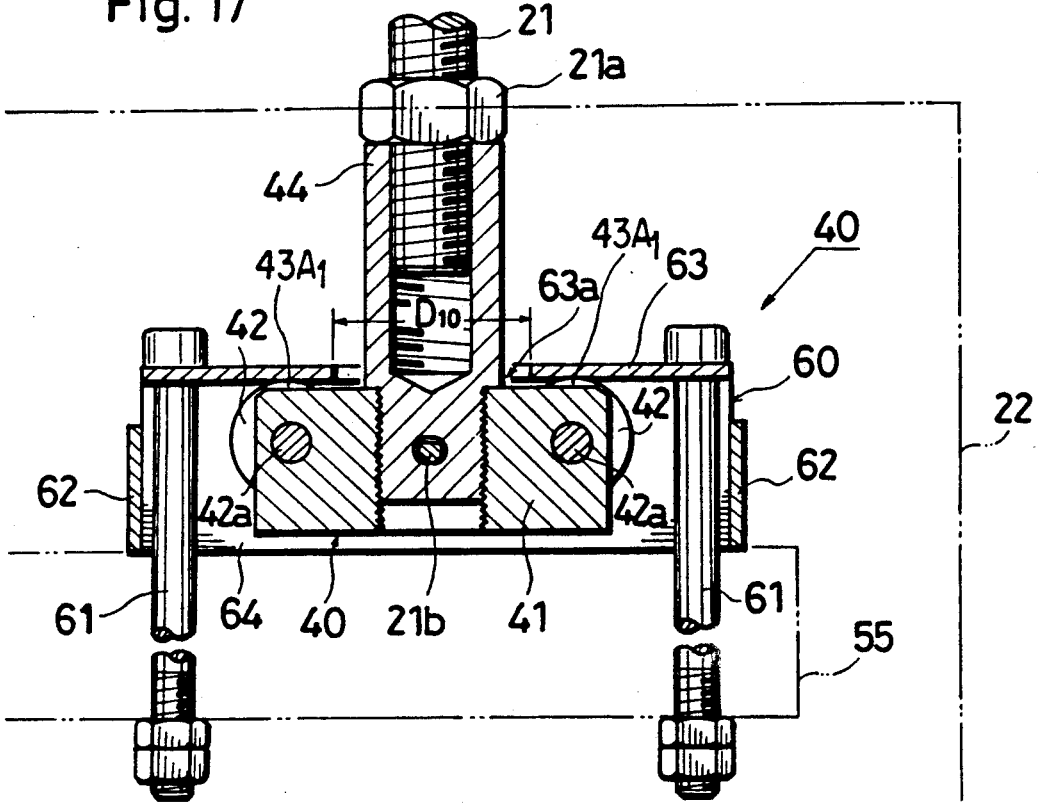
FIG. 17 is a sectional view showing another example of the controller device.

FIG. 17 is a sectional view showing another controller device 40 of the present invention. The controller device 40 is composed of a body block 41 and a floating rail 60.

The floating rail 60 is in the form of a frame with a lower portion opened in which a pair of side frames 64 and an upper frame 63 are integrally molded, and reinforcing plates 62 are attached to both ends of the side frame 64. The upper frame 63 is formed at its central portion with a slot 63a and collectively secured to a frame 55 of the panel body by means of four fixing bolts 61, 61 . . . at four corners. The body block 41 is provided with two pairs of hanging rollers 42, 42 . . . and a connecting socket 44. The hanging rollers 42, 42 . . . are mounted on both sides of the body block 41 through a pair of through extending shafts 42a and 42a disposed laterally of the body block 41. The hanging rollers 42, 42 . . . are located so that the outer peripheral portion thereof is projected upwardly of the body block 41, and the upward side thereof forms a contact with the upper frame 63.

The connecting socket 44 is threadedly mounted in a upright state on the center portion of the body block 41 and a lock pin 21b is placed. The connecting socket 44 is provided with a threaded hole to be connected with a hanging bolt provided on the runner side of the ceiling and in addition is provided with a lock nut 21a. The threaded hole has a sufficient depth so that a height of the panel body 22 suspended therefrom can be adjusted.

The body block 41 is incorporated into a floating rail 60 by passing the connecting socket 44 into a slot 63a of the upper frame 63, and the lower surface of the upper frame forms travel surfaces for the hanging rollers 42, 42 . . . It is noted that a spacing between the side frames 64 and 64 facing to each other is set slightly larger than the maximum mounting width of the hanging rollers 42 . . . , and the body block 41 is defined in its travel direction by the side frames 64 and 64 when the floating rail 60 moves in a longitudinal direction. The moving width is defined by a length $D_{10}$ of the slot 63a. In mounting the floating rail 60, a lower hole for inserting the fixing bolts 61, 61 . . . into the frame 55 in advance is prepared whereby the mounting work can be extremely simply completed merely by fasting work of the fixing bolts 61, 61 . . .

In the panel body 22 which incorporates therein the controller devices 40 the same in number as that of the hanging bolts 21, it is possible to allow the one-sided motion of the panel body 22 irrespective of the direction of the runner devices 10 and 10 hanging the panel body 22 since the body block 41 can be moved relative to the floating rail 60.

Figure 18:
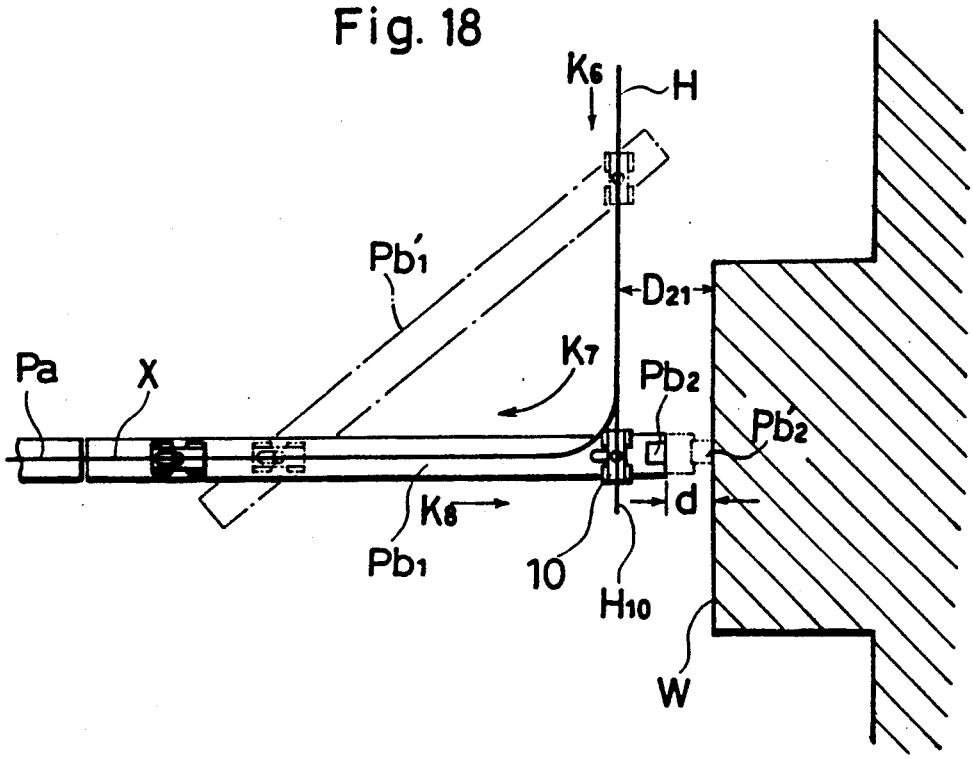
FIG. 18 is an explanatory view of operation of the controller device shown in FIG. 17.

For example, in the case where partitioning work is carried out with a partitioning panel $Pb_1$ having been moved in a direction as indicated as arrow $K_6$ of FIG. 18 along a hanger rail H as shown in FIG. 18 aligned in a direction of a hanger rail X perpendicular to the hanger rail H, each partitioning panel is rotated in a direction as indicated at arrow K, of the figure, and therefore, there occurs the condition that a gap $D_{21}$ between the hanger rail H and a wall surface W cannot be made to a value less than a predetermined value (as indicated by the phantom line in the figure).

As a result, the hanger H is provided with an extension portion $H_{10}$, and the runner device 10 close to the wall surface of a final partitioning panel $Pb_1'$ is not fed to the hanger rail X but is stopped at the extension portion $H_{10}$. The direction of the runner device 10 remains the same as that of the hanger rail H but at that time, the controller device 40 mounted on the partitioning panel $Pb_1$ allows the partitioning panel $Pb_1$ one-sided in the direction as indicated at arrow $K_8$ despite the direction of the runner device 10. Therefore, the partitioning panel $Pb_1$ can suitably adjust the gap d relative to the wall surface W. That is, the partitioning panel $Pb_1$ is moved in directions of arrows $K_6$, $K_7$ and $K_8$ to thereby correct one-siding with respect to the wall surface W, keep visual balance and narrow the gap d. Thereby, a movable seal member $Pb_2$ incorporated in the partitioning panel $Pb_1$ can be used to completely close the gap d.

As described above, according to the present invention, a pair of hanging bolts, a pair of controller devices and a floating rail are combined to form a unitary body. Thereby, mounting and removal with respect to the partitioning panel may be accomplished very easily. For example, maintenance for problems such as a crack in a hanging roller can be carried out simply. In addition, since a floating rail is not incorporated into a partioning panel but is combined integrally with the controller and installed externally of the partitioning panel, additional mounting work to an existing partitioning panel can be accomplished simply. Furthermore, there is an excellent effect in that mounting a partitioning panel can be carried out extremely simply in accordance with the the one-sided motion.

Obviously, numerous modifications and variations of the present invention are possible in light of the above teachings. It is therefore to be understood that within the scope of the appended claims, the invention may be practiced otherwise than as specifically described herein.

What is claimed is:

1. A movable partitioning panel assembly, which comprises:

a panel;

a hanger rail having a C-shape in section;

a pair of hanging bolts for movably suspending said panel from said hanger rail;

a runner device with travel rollers wherein an upper end of each of said pair of hanging bolts is rotatably supported on said runner device;

a controller device horizontally movable with respect to said panel is disposed on a lower end of at least one of said hanging bolts; and a hanger block mounted on the panel body; and a hanging member supported by said hanger block, said hanger block being mounted on said panel by said hanging member and said hanger block being in one of a point contact and a line contact along a longitudinal direction of the panel with respect to said hanging member wherein at least two roller members are provided at said hanger block.

2. A movable partitioning panel according to claim 1, wherein said hanger block has an upwardly convex shape in section.

3. A movable partitioning panel according to claim 1, wherein the upper surface of said hanging member is formed into a downwardly concave shape.

4. A movable partitioning panel according to claim 1, wherein a central portion of a peripheral surface of said at least two roller members is formed of a convex shape.

5. A movable partitioning panel according to claim 1, wherein two or more roller members each having a peripheral surface projected of the upper surface of said hanger block are provided along the longitudinal direction of the panel body on a center line of said hanger block, and a central portion of the upper surface of the hanging member is formed into a downwardly convex shape.

6. A movable partitioning panel according to claim 1, wherein said controller device comprises a body block and a floating rail having said body block movably fitted thereto, said floating rail having a slot formed in a longitudinal direction of the panel, a hanging bolt which projects on the body block extending through said slot, and a hanging roller having a horizontal axis perpendicular to said slot is mounted on said body block so as to project a peripheral surface from the upper surface of said body block.

7. A movable partitioning panel according to claim 6, wherein a lower portion of said hanging bolt is threadedly engaged with the body block through a connecting socket.

8. A movable partitioning panel according to claim 1, which comprises a thrust bearing wherein the upper end of said hanging bolt is supported on the runner device by said thrust bearing, a lower guide roller rotatable within a lower slit portion of the hanger rail is disposed at a lower portion of said runner device, and upper guide rollers which roll along a guide rail are disposed upwardly of the hanger rail and are provided upwardly of said runner device.

9. A movable partitioning panel according to claim 8, wherein said upper guide rollers are disposed so as to be deviated toward one side from a center line of a travel direction of the runner device.

10. A movable partitioning panel according to claim 9, wherein said floating rail is detachably mounted on the panel body by bolts.

* * * * *